United States Patent [19]

Davis

[11] 3,943,997

[45] Mar. 16, 1976

[54] ROTARY DRILLING APPARATUS AND METHOD

[76] Inventor: Haggai D. Davis, 1910 McDermott Drive, Morgan City, La. 70380

[22] Filed: Dec. 12, 1974

[21] Appl. No.: 531,903

[52] U.S. Cl. ..... 166/312; 134/15; 134/151; 166/90; 175/422

[51] Int. Cl.². E21B 37/00; E21B 33/03; E21B 7/18

[58] Field of Search ..... 175/208, 67, 422, 209; 15/104.04; 166/56, 90, 312; 134/15, 151, 198

[56] References Cited

UNITED STATES PATENTS

| | | | |
|---|---|---|---|
| 1,521,390 | 12/1924 | Reynolds | 166/90 |
| 1,566,419 | 12/1925 | O'Neill et al. | 166/90 |
| 2,041,394 | 5/1936 | Belcher | 166/90 |
| 3,763,936 | 10/1973 | Menage | 166/90 |

*Primary Examiner*—James A. Leppink
*Attorney, Agent, or Firm*—Jennings B. Thompson

[57] ABSTRACT

A rotary drilling apparatus and method are disclosed in which well tools are washed as they are pulled from the well bore and large pieces of formation are broken into pieces small enough to pass through the mud return line by directing a plurality of streams of drilling mud against the tools and the pieces of formation as they pass through the bell nipple. The material washed off the tools and the pieces of the broken up larger pieces of formation are carried from the bell nipple laterally with the mud through the mud return line. A plurality of nozzles are mounted on the bell nipple for this purpose and each nozzle includes a flow restricting member that can be easily removed and replaced when it becomes fluid cut.

8 Claims, 4 Drawing Figures

FIG. 1
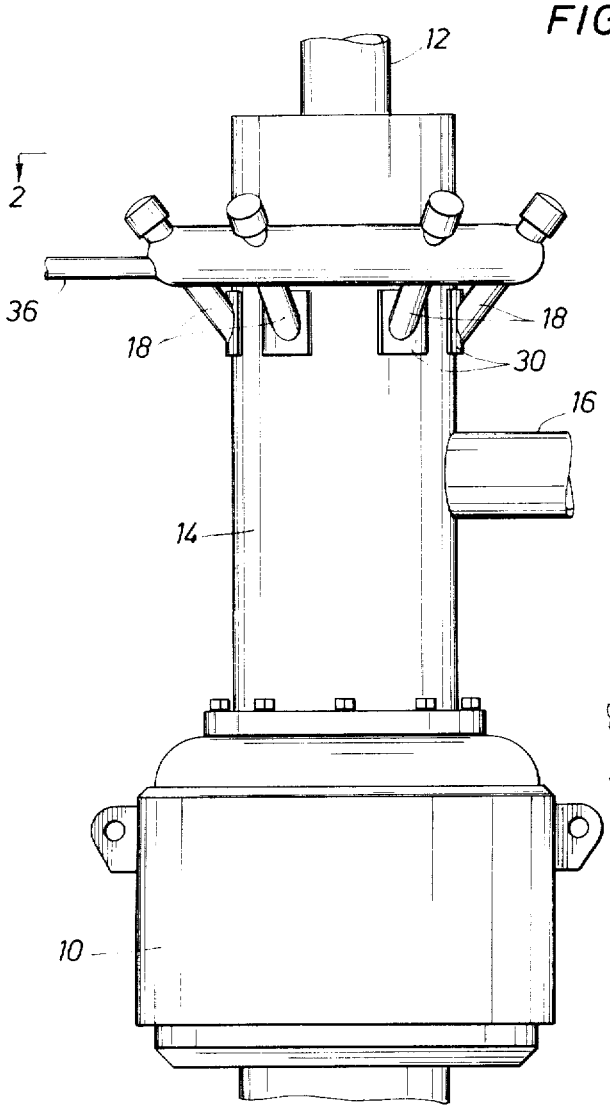
FIG. 2
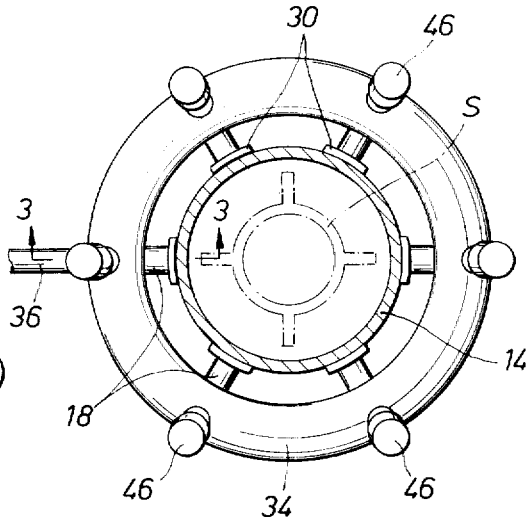
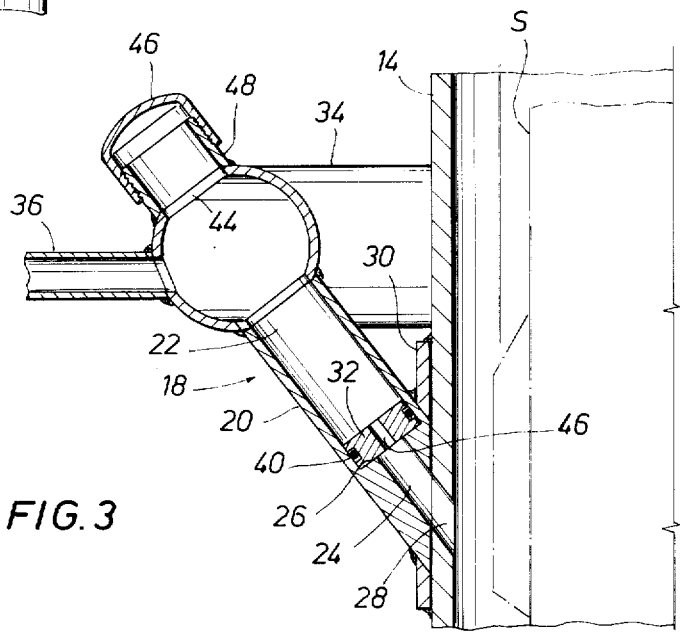
FIG. 3

ROTARY DRILLING APPARATUS AND METHOD

This invention relates to rotary drilling generally, and in particular to apparatus for and a method of washing well tools, such as stabilizers, as they are pulled from the well bore and for breaking up any large pieces of formation that are carried to the surface by the drilling mud.

The apparatus and method of this invention can be used to wash all the well tools, including the drill pipe in a drill string. It is particularly useful, however, for washing stabilizers. Stabilizers are used to space the drill string from the wall of the well bore, hopefully in axial alignment with the center of the well bore. Therefore, stabilizers are designed to contact the walls of the well bore, usually through laterally extending blades mounted on a tubular body carried by the drill string. Bit cuttings, wall cake and portions of the formation in which the blades are in contact build up between the blades and the stabilizer body during the drilling operation.

When the pipe string is removed from the well bore to change the bit or for any pupose, it is important for at least two reasons that any of the material adhering to the stabilizers is removed. First, if the build-up of material is allowed to remain on the stabilizer, when the stabilizer is again lowered into the hole with the drill string, the flow of drilling fluid around the stabilizer as it is lowered into the well bore will be restricted. This can result in a pressure build-up below the stabilizers each time the pipe string is lowered. As has happened many times, these pressure build-ups can break down exposed formations. At the least, this will result in a loss of some of the expensive drilling mud in the hole. It can also create a situation where the formation will take the drilling fluid continuously at normal hydrostatic pressure. This may require the addition of circulation loss preventing material to the drilling mud, which complicates the drilling operation. In extreme cases, it is necessary to pump cement into the formation to seal it off. All of this results in the loss of valuable time.

Secondly, the drill pipe making up a drill string is usually racked vertically in the derrick when it is pulled from the hole in stands of three joints each. Since the stabilizers are spaced at various points in the drill string, it is not unusual for a stabilizer to be located near the top of a strand of drill pipe when it is broken out of the string and set back in the derrick. If the stabilizer is not cleaned when it comes through the rotary table, the material adhering to the stabilizer will dry in the air and on many occasions has fallen off the stabilizer to the floor of the drilling rig in large chunks providing a very hazardous condition to the people working on the floor of the drilling rig.

It is an object of this invention to provide apparatus for and a method of cleaning well tools, such as stabilizers, before the well tools are pulled through the rotary table of the drilling rig. This insures that such well tools can be set back in the derrick above the workmen's heads without any danger of material falling onto the workmen, and it also saves much of the time that is otherwise spent in cleaning such tools after they are pulled above the rotary table. In addition, when well tools are cleaned above the rotary table, the material that is removed falls into the rotary table and the adjacent floor of the drilling rig. This material is wet when removed making it slick thereby creating an unsafe working area.

It is a further object of this invention to provide apparatus that will provide a plurality of jets of drilling fluid against the outer surface of a well tool before it reaches the rotary table to remove debris therefrom. An additional advantage obtained here is that by using drilling fluid as the cleaning agent, and by directing this drilling fluid against the well tool before it passes out of the bell nipple below the rotary table, the drilling fluid is not polluted by water which would be one of the agents used if the tool was cleaned above the rotary table.

It is another object of this invention to provide a method of and apparatus for washing well tools that removes the material washed from the tool from the bell nipple through the mud return line. This is advantageous not only because it keeps the material, or at least most of it, from sinking through the mud down the well bore, but also keeps the well bore full of drilling mud up to the level of the mud return line. This is very important because it reduces the chances of the well blowing out by maintaining the maximum hydrostatic head of fluid against any producing formation that may have been penetrated by the well bore.

This invention has utility in addition to cleaning well tools. When drilling certain formations, large pieces of the formation appear at the surface. It is not known for sure whether the pieces are sloughed off the wall of the well bore or are the result of the agglomeration of bit cuttings as the cuttings move toward the surface. Whatever the reason, when these large pieces of formation reach the surface they plug up the mud return line and often the bell nipple itself to the extent that drilling operations have to be stopped until these pieces of formation are removed. This phenomena occurs primarily while drilling surface clays of the type commonly called "gumbo".

Therefore, it is another object of this invention to provide apparatus for and a method of breaking up any large pieces of formation that reaches the surface during drilling operations to keep such pieces from plugging the bell nipple or the mud return line.

It is another object of this invention to provide a method of drilling formations, such as gumbo, wherein a plurality of streams of drilling mud are injected into the mud as it returns to the surface to break up any large pieces of formation in the mud before they plug or stop up the mud return system.

It is a further object of this invention to provide apparatus for cleaning well tools as they pass through the bell nipple of a rotary rig and for breaking up any large pieces of formation that reach the surface that includes a plurality of nozzles that have replaceable flow restricting means therein so that such flow restricting means can be removed and replaced when cut out by the drilling fluid or when it is desirable to change the size of the opening in the flow restricting means.

These and other objects, advantages, and features of this invention will be apparent to those skilled in the art from a consideration of this specification, including the attached drawings and appended claims.

In the drawings:

FIG. 1 is a view in elevation of the upper blowout preventer and bell nipple of a conventional blowout preventer stack located just below the rotary table of a rotary drilling rig with the preferred embodiment of the apparatus of this invention installed on the bell nipple of the mud return system;

FIG. 2 is a sectional view taken along line 2—2 of FIG. 1;

FIG. 3 is a sectional view taken along line 3—3 of FIG. 2; and

Figure 4:
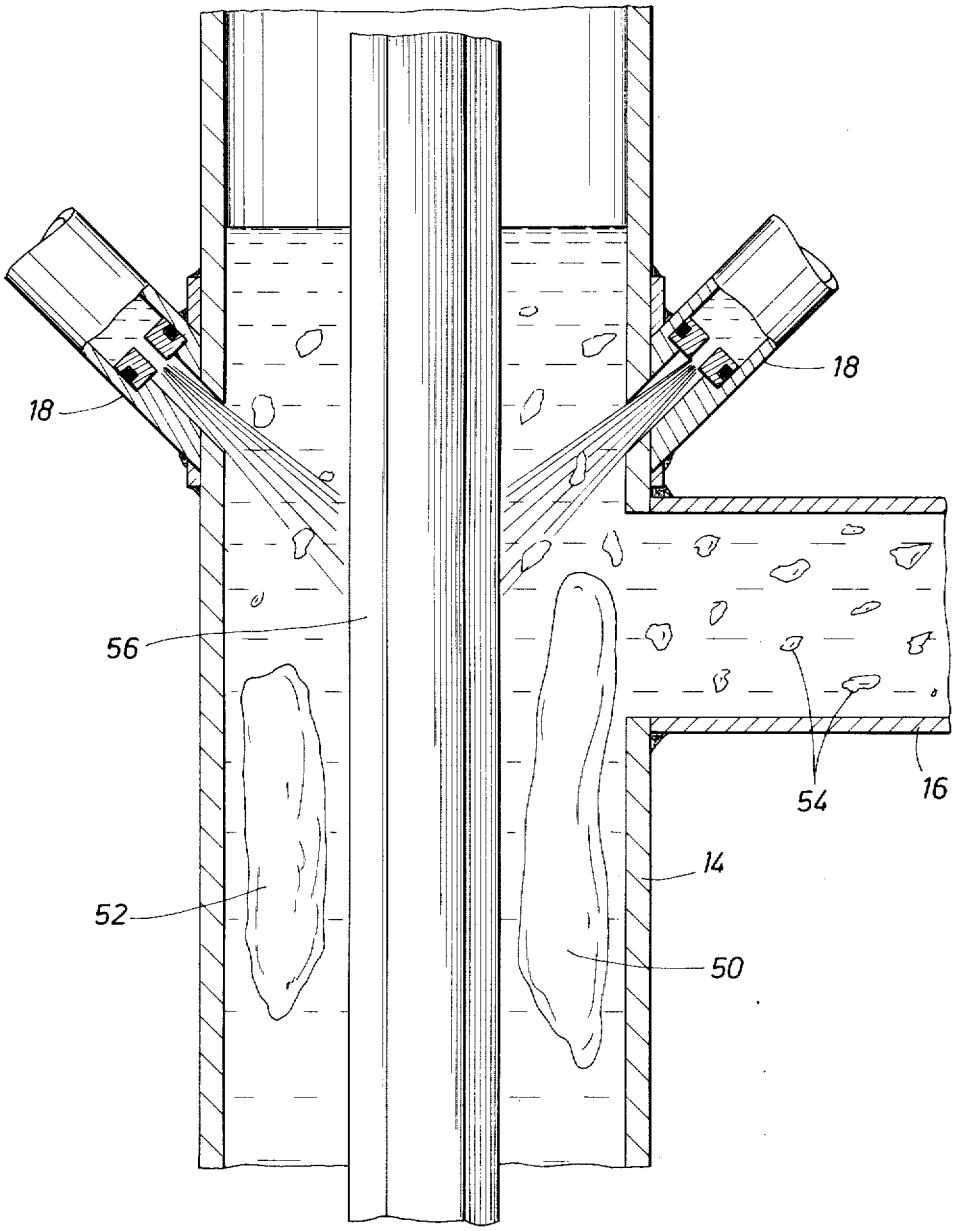
FIG. 4 is a sectional view of the apparatus of the invention as it is used to break up large pieces of formation reaching the surface during drilling operations.

In rotary drilling operations, the drill string extends into the well bore through a blowout preventer and mud return system assembly. A blowout preventer assembly or stack will include one or more blowout preventers in stacked alignment with the well bore. In FIG. 1, only the top preventer, indicated by the number 10, is shown. Drill string 12 extends through the blowout preventer stack, and during drilling operations will have a bit on the end thereof. Drilling fluid is pumped down through drill string 12, out the drill bit and back to the surface between the drill string and the wall of the well bore or any casing that may already be set in the well bore. This drilling fluid passes up through the blowout preventer stack into the mud return system which includes bell nipple 14 attached to top blowout preventer 10 and laterally extending mud return line 16. The mud flows upwardly in the bell nipple, then laterally through mud return line 16 to the shale shaker and the storage pits, where it is again picked up by the mud pumps and pumped down the drill string.

According to this invention, a plurality of nozzles 18 are mounted on the bell nipple through which drilling mud can be pumped to provide a plurality of streams of drilling mud that are directed toward the outer surface of a well tool passing through the bell nipple to clean the outer surface thereof or to break up any large pieces of formation reaching the bell nipple. In accordance with the method and the preferred embodiment of the apparatus of this invention, the nozzles are mounted on the bell nipple above mud return line 16. All of the nozzles have the same construction, so only one will be described in detail. Referring to FIG. 3, nozzle 18 includes tubular nozzle housing 20. The housing has a passageway therethrough, portion 22 thereof, being larger in diameter than portion 24 to provide annular shoulder 26. Passageway portions 22 and 24 are in alignment with each other and with opening 28 through bell nipple 14. Nozzle housing 20 is attached to mounting flange 30 which is attached to the outside of the bell nipple, as by welding, to hold the nozzle housing in the desired position with its passageways in alignment with opening 28 in the wall of the bell nipple. Mounting flange 30 is welded to the bell nipple also to prevent the flow of drilling fluid out of opening 28 and between the bell nipple and the mounting flange. The desired acceleration in the mud pumped through the nozzle is provided by disc-shaped flow restricting member 32 which is positioned in portion 22 of the passageway in engagement with shoulder 26.

Means are provided to supply the nozzles with fluid under pressure. In the embodiment shown, such means include circular shaped tubular header 34 which encircles the bell nipple and is attached to the inlet end of each nozzle housing.

As discussed above, when pulling a drill string out of a well bore, the level of drilling mud in the well bore will drop as the pipe is removed therefrom. If producing formations are exposed in the well bore, a drop in the level of the drilling fluid may reduce the hydrostatic pressure opposite the producing formation to less than formation pressure and fluids in the formation will flow into the well bore and a blowout can occur. For this reason, it is a common practice to connect a line from the mud pumps of the rig to the bell nipple, commonly called a fill-up line, through which drilling fluid can be added to the well bore as the pipe is pulled out of the hole to maintain the level of drilling fluid at or near the surface, which in turn maintains the hydrostatic pressure of the entire column of fluid opposite any producing formations.

In the embodiment shown, fill-up line 36 is connected to header 34. For ordinary fill up purposes, then, fluid is pumped into the header by the mud pumps and passes into the bell nipple through the nozzles to keep the hole full of drilling mud up to the mud return line. When a stabilizer, such as stabilizer S shown dotted, or other well tool that needs cleaning, approaches the bell nipple, the pressure in the fill-up line can be increased sufficiently to provide a stream of drilling mud from each of nozzles 18 having sufficient velocity to clean the tool as it passes through the bell nipple. It may be desirable, in some instances, to pump continuously through the fill-up line so that the cleaning action on the well string will be continuous as the well string is pulled from the well bore. This will also insure that the fluid level is maintained at the highest possible point at all times. Any excess fluid pumped into the bell nipple will simply flow through the mud return line back to the mud pits. As shown, nozzles 18 are mounted at approximately 50° from the horizontal so that the mud stream from the nozzle strikes the well tools at a downwardly inclined angle. Preferably, the nozzles are aimed downwardly at an angle between about 30° to about 60° from the horizontal.

In the practice of the method of this invention to clean well tools, the nozzles provide a plurality of streams of drilling mud above the mud return line to wash off material adhering to a well tool. This material falls or is carried by the drilling mud downwardly in the bell nipple where it enters the laterally flowing stream of mud entering the mud return line. Thus, the material is not only washed from the well tools before the tools are pulled out of the bell nipple to the floor of the drilling rig, but also the material removed is carried out of the bell nipple with the drilling mud where it can be separated from the mud by the shale shaker.

As explained above, when drilling certain types of formations, such as the "gumbo" of the Gulf Coast, large pieces of formation find their way to the surface. The pieces small enough enter the mud return line where they settle out and reduce the capacity of the line or, in many cases, plug it completely. In either event, the returning mud being restricted or prevented from flowing through the mud return line, will flow over the top of the bell nipple. Drilling operations will then have to stop while the return line is cleaned of these pieces of formation. Where the pieces are too large for the return line, such as pieces 50 and 52 in FIG. 4, they will move with the mud to the inlet of return line 16 and prevent or restrict the flow of mud into the line and again the bell nipple will overflow.

As shown in FIG. 4, by pumping drilling mud through nozzles 18 during the drilling operation, a plurality of high velocity streams of drilling mud will be provided to strike pieces 50 and 52 of formation as they move upwardly in the bell nipple and break up these pieces into much smaller pieces 54 before they can enter or stop up the mud return line. The smaller pieces of formation will then be carried laterally with the drilling mud through the mud return line to the shale shaker where they are separated from the mud.

When used for this purpose, the nozzles should be positioned so the high velocity streams of mud discharged therefrom will engage and break up the pieces of formation before such pieces can enter or plug up the mud return line.

Since in FIG. 4, drilling operations are being performed, the upper portion of the drill string is shown as kelly 56.

As explained above, flow restricting member 32 is held in place by shoulder 26. Seal ring 40 carried by the member prevents the flow of drilling mud around the outside of the member and forces all of the mud to flow through opening 42 in the member.

The flow restricting member or orifice 32 serves to impart an increase in velocity to the drilling mud that is sufficient to provide the desired cleaning and dispursing action. Consequently, even though such members are made or coated usually with very hard material, they will suffer from fluid erosion, and eventually have to be replaced. It is a feature of this invention that the flow restricting means or orifice of each nozzle can be removed and replaced when desired.

In the embodiment shown, openings 44 are located in the side of header 34 diametrically opposite nozzle housing 20. Normally, the openings are closed by caps 46 attached to nipples 48. When it is desired to replace one of nozzle orifices 32, the cap associated with the nozzle can be removed and the orifice removed through the nozzle housing, the header, and opening 44 and replaced.

From the foregoing, it will be seen that this invention is one well adapted to attain all of the ends and objects hereinabove set forth, together with other advantages which are obvious and which are inherent to the apparatus and method.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, what is claimed is:

1. Apparatus mounted on the bell nipple of a rotary drilling rig above the mud return line for breaking up large pieces of formation, such as gumbo, as the pieces reach the surface of the drilling mud in the bell nipple during drilling operations comprising a plurality of nozzles, means mounting the nozzles on the bell nipple directly above the mud return line whereby fluid flowing through the nozzles is directed into the mud as the mud reaches the mud return line to break up large pieces of formation as they reach the mud return line, and means for pumping drilling mud through the nozzles while drilling mud is being pumped upwardly in the bell nipple and laterally through the mud return line to carry pieces of formation from the well bore.

2. The apparatus of claim 1 in which the mounting means includes a circular tubular header to which each nozzle is connected and through which each nozzle is supplied with drilling mud.

3. The apparatus of claim 1 in which each nozzle includes a tubular housing having an inlet and an outlet and a flow restriction positioned in the housing adjacent the outlet to increase the velocity of the mud flowing through the housing before it leaves the housing through the outlet.

4. The apparatus of claim 3 in which the flow restriction is removable through the inlet end of the nozzle housing and in which the tubular header is provided with openings positioned thereon opposite the inlets to the nozzle housings through which the flow restrictions can be moved into and out of position in the nozzle housings and removable means for closing the openings.

5. The apparatus of claim 3 in which the nozzles are mounted to direct the mud flowing from the outlets thereof downwardly at an angle from the horizontal of between thirty and sixty degrees.

6. Apparatus for use with the bell nipple and mud return line of a rotary drilling rig to wash well tools before they pass out of the bell nipple below the rotary table, said apparatus comprising a plurality of openings in the bell nipple above the mud return line, a plurality of nozzles, means mounting the nozzles on the bell nipple to direct a plurality of streams of drilling mud flowing through the nozzles through the openings in the bell nipple against a well tool passing through the bell nipple, and means for supplying the nozzles with drilling mud under pressure when it is desired to clean a well tool as it passes through the bell nipple, each nozzle including a tubular housing having a passageway therethrough in alignment with one of the openings in the bell nipple through which the drilling mud passes into the bell nipple, said passageway having a portion of reduced diameter adjacent the opening in the bell nipple to provide an annular shoulder facing opposite the direction of flow of the drilling mud, a disc-shaped flow restricting member positioned in the passageway in engagement with said shoulder having an opening of reduced diameter to restrict the flow of drilling mud through the passageway and increase the velocity of the drilling mud before it enters the bell nipple and seal means located between the flow restricting member and the housing.

7. The apparatus of claim 6 in which the mounting means includes a circular shaped tubular header that encircles the bell nipple and is connected to the tubular housings of the nozzles to provide a common conduit through which drilling mud under pressure is supplied to the nozzles, said header having openings therein opposite from and in alignment with the passageways of the nozzle housings and covers for said openings that can be removed to allow the flow restricting members of the nozzles to be removed from the housings through the openings and replaced.

8. A method of rotary drilling comprising circulating drilling mud down the drill string and up the annulus into the bell nipple and laterally through a mud return line to the shale shaker and storage pits to carry pieces of formation out of the well bore, positioning a plurality of nozzles in the bell nipple adjacent the mud return line to direct their discharge into the mud as it reaches the mud return line and directing a plurality of streams of drilling mud through the nozzles against the pieces of formation carried to the surface by the drilling mud as they reach the mud return line to break up the pieces sufficiently to flow laterally with the mud through the mud return line.

* * * * *